US010957282B2

(12) United States Patent
Hei et al.

(10) Patent No.: US 10,957,282 B2
(45) Date of Patent: Mar. 23, 2021

(54) LUMINANCE COMPENSATION METHOD FOR A DISPLAY PANEL

(71) Applicant: Wuhan Tianma Micro-Electronics Co., Ltd., Wuhan (CN)

(72) Inventors: Yajun Hei, Wuhan (CN); Jingxiong Zhou, Wuhan (CN); Ruiyuan Zhou, Wuhan (CN)

(73) Assignee: WUHAN TIANMA MICRO-ELECTRONICS CO., LTD., Shanghai (CN)

( * ) Notice: Subject to any disclaimer, the term of this patent is extended or adjusted under 35 U.S.C. 154(b) by 0 days.

(21) Appl. No.: 16/457,375

(22) Filed: Jun. 28, 2019

(65) Prior Publication Data

US 2020/0286447 A1 Sep. 10, 2020

(30) Foreign Application Priority Data

Mar. 7, 2019 (CN) ..... 201910171961.1

(51) Int. Cl.
*G09G 5/10* (2006.01)
*G09G 3/3208* (2016.01)

(52) U.S. Cl.
CPC ..... *G09G 5/10* (2013.01); *G09G 3/3208* (2013.01); *G09G 2300/0452* (2013.01); *G09G 2320/029* (2013.01); *G09G 2320/0233* (2013.01)

(58) Field of Classification Search
CPC ..... G09G 5/10; G09G 2300/0452; G09G 2320/0233; G09G 2320/029; G09G 3/364; G09G 3/3208
See application file for complete search history.

(56) References Cited

U.S. PATENT DOCUMENTS

2013/0321497 A1* 12/2013 Kang ..... G09G 3/3648 345/694
2014/0192099 A1* 7/2014 Inoue ..... G09G 3/3208 345/690
2016/0247432 A1* 8/2016 Hu ..... G09G 5/02

FOREIGN PATENT DOCUMENTS

CN 104954797 A 9/2015
CN 105206239 A 12/2015
(Continued)

OTHER PUBLICATIONS

Chinese Office Action for application No. 201910171961.1; dated Apr. 26, 2020.

*Primary Examiner* — Antonio A Caschera
(74) *Attorney, Agent, or Firm* — Miller, Matthias & Hull LLP

(57) ABSTRACT

A luminance compensation method for a display panel includes: dividing the display area into at least two sub-display areas including a first sub-display area and a second sub-display area, where a density of luminance abnormal textures in the first sub-display area is smaller than that in the second sub-display area, a number of types of the luminance abnormal textures in the first sub-display area is less than that in the second sub-display area; dividing the first sub-display area into a plurality of first compensation units, dividing the second sub-display area into at least one second compensation unit, where a total number of pixel units in each first compensation unit is greater than that in each second compensation unit; obtaining a compensation coefficient of each compensation unit and forming a compensation coefficient table; performing luminance compensation for the display panel according to the compensation coefficient table.

14 Claims, 7 Drawing Sheets

(56) References Cited

FOREIGN PATENT DOCUMENTS

| | | | |
|---|---|---|---|
| CN | 105700847 | A | 6/2016 |
| CN | 107731152 | A | 2/2018 |
| CN | 108493227 | A | 9/2018 |
| CN | 109119035 | A | 1/2019 |

* cited by examiner

LUMINANCE COMPENSATION METHOD FOR A DISPLAY PANEL

CROSS-REFERENCES TO RELATED APPLICATIONS

This application claims priority to a Chinese patent application No. 201910171961.1 filed on Mar. 7, 2019, disclosure of which is incorporated herein by reference in its entirety.

TECHNICAL FIELD

The present disclosure relates to luminance compensation techniques for a display panel and, in particular, to a luminance compensation method for a display panel.

BACKGROUND

The organic light emitting diode (OLED) has been widely used in various electronic devices due to its advantages, such as self-illumination, requiring no backlight, low power consumption and high luminance.

FIG. 1 is sectional view of an OLED pixel according to an embodiment of the present disclosure. As shown in FIG. 1, the OLED pixel includes a substrate 1 and an insulating layer 2. Further, the OLED pixel further includes a drive circuit (not shown), an anode 102, an organic light-emitting function layer 103 and a cathode 104. In FIG. 1, a drive thin film transistor 101 in the drive circuit (not shown) represents the drive circuit (not shown). An input terminal of the drive circuit (not shown) and the cathode 104 are respectively connected to a positive power source signal line and a negative power source signal line. In a light-emitting process of the OLED pixel, the drive thin film transistor 101 is turned on under combined action of scanning lines and data lines of the display panel; an anode driving signal is applied to the anode 102 through the drive circuit, and a cathode driving signal is directly applied to the cathode 104. An electric field is formed between the anode 102 and the cathode 104. The organic light-emitting function layer 103 emits light under the action of the electric field. A power supply signal is provided by a driving integrated circuit (IC) located in a non-display area via a power signal line to each drive circuits (not shown) located in the display area. However, due to the impedance of the power signal line, when a current flows, the power signal generates a voltage drop on the power signal line, causing the attenuation of the power signal actually received by the drive circuit, affecting the luminance of the OLED pixel and resulting in the uneven luminance on the OLED display panel.

SUMMARY

The present disclosure provides a luminance compensation method for a display panel to implement a better luminance compensation effect by using less compensation coefficient data.

An embodiment of the present disclosure provides a luminance compensation method for a display panel. The display panel includes a display area and a non-display area surrounding the display area, and the luminance compensation method includes:

dividing the display area into at least two sub-display areas, where the at least two sub-display areas include a first sub-display area and a second sub-display area, the display area includes luminance abnormal textures, a density of the luminance abnormal textures in the first sub-display area is less than a density of the luminance abnormal textures in the second sub-display area, types of the luminance abnormal textures in the first sub-display area are less than types of the luminance abnormal textures in the second sub-display area, and the luminance abnormal textures include a plurality of sub-pixels;

dividing the first sub-display area into a plurality of first compensation units, and dividing the second sub-display area into at least one second compensation unit, where the display area includes a plurality of pixel units, the number of the pixel units in each of the plurality of first compensation units is greater than the number of the pixel units in each of the at least one second compensation unit, and each of the plurality of pixel units includes at least two sub-pixels of different colors;

obtaining a compensation coefficient of each of the plurality of first compensation units and the at least one second compensation unit and forming a compensation coefficient table; and performing luminance compensation for the display panel according to the compensation coefficient table.

According to the luminance compensation method for the display panel provided by the embodiment of the present disclosure, the display area of the display panel is divided into at least two sub-display areas, a manner for dividing compensation units in each sub-display area is determined according to the density and types of the luminance abnormal textures in each sub-display area, the compensation coefficient of each divided compensation unit is obtained and the compensation coefficient table is formed, and the luminance compensation for the display panel is performed according to the compensation coefficient table. In this way, the higher the density of the luminance abnormal textures and the more types of the luminance abnormal textures, the fewer pixel units in the compensation unit, thereby implementing the fine compensation for the sub-display area with poor display quality and the large scale uniform compensation for the sub-display area with better display quality, and obtaining a better luminance compensation effect by using less compensation coefficient data.

BRIEF DESCRIPTION OF DRAWINGS

Other features, objects and advantages of the present disclosure will become more apparent from a detailed description of non-restrictive embodiments with reference to the drawings.

DETAILED DESCRIPTION

Figure 1:
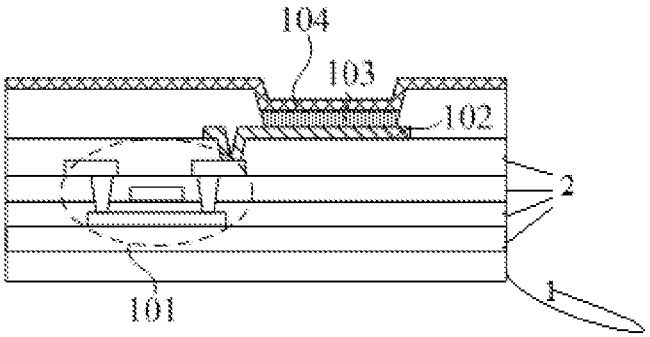
FIG. 1 is sectional view of an OLED pixel according to an embodiment of the present disclosure.

To elucidate technical means and technical effects for achieving an intended purpose of the present disclosure, embodiments, structures, features and effects of a luminance compensation method for a display panel provided according to the present disclosure are described hereinafter in detail with reference to drawings and exemplary embodiments.

An embodiment of the present disclosure provides a luminance compensation method for a display panel. The display panel includes a display area and a non-display area surrounding the display area, and the luminance compensation method includes:

dividing the display area into at least two sub-display areas, where the at least two sub-display areas include a first sub-display area and a second sub-display area, the display area includes luminance abnormal textures, a density of the luminance abnormal textures in the first sub-display area is smaller than a density of the luminance abnormal textures in the second sub-display area, types of the luminance abnormal textures in the first sub-display area are less than types of the luminance abnormal textures in the second sub-display area, and the luminance abnormal textures include a plurality of sub-pixels;

dividing the first sub-display area into a plurality of first compensation units, and dividing the second sub-display area into at least second compensation unit, where the display area includes a plurality of pixel units, the number of the pixel units in the plurality of first compensation units is greater than the number of the pixel units in the at least one second compensation unit, and each of the plurality of pixel units includes at least two sub-pixels of different colors;

obtaining a compensation coefficient of each of the plurality of first compensation units and the at least one second compensation unit and forming a compensation coefficient table; and performing luminance compensation for the display panel according to the compensation coefficient table.

The luminance compensation method for the display panel provided by the embodiment of the present disclosure divides the display area of the display panel into at least two sub-display areas, determines a manner for dividing compensation units in each sub-display area according to the density and types of the luminance abnormal textures in each sub-display area, obtains the compensation coefficient of each divided compensation unit and forms the compensation coefficient table, and compensates for the luminance of the display panel according to the compensation coefficient table, so that the higher the density of the luminance abnormal textures and the more types of the luminance abnormal textures, the fewer pixel units in the compensation unit, thereby implementing the fine compensation for the sub-display area with poor display quality and the large scale uniform compensation for the sub-display area with better display quality, and obtaining a better luminance compensation effect by using less compensation coefficient data.

The technical solutions in the embodiments of the present disclosure will be described clearly and completely in connection with the drawings in the embodiments of the present disclosure. The embodiments described below are part, not all, of the embodiments of the present disclosure. Based on the embodiments of the present disclosure, all other embodiments obtained by those skilled in the art without making creative work are within the scope of the present disclosure.

Details are set forth below to facilitate a thorough understanding of the present disclosure. However, the present disclosure may be implemented by other embodiments different from the embodiments described herein, and those skilled in the art may make similar generalizations without departing from the spirit of the present disclosure. Therefore, the disclosure is not limited to the specific embodiments described below.

In addition, the present disclosure will be described in detail in conjunction with the drawings. In detailed description of embodiments of the present disclosure, for ease of description, schematic diagrams illustrating structures of devices and components are not partially enlarged in accordance with a general proportional scale. The schematic diagrams are merely illustrative and are not intended to limit the scope of the present disclosure. In addition, manufacturing includes three-dimension spatial sizes: length, width and height.

Figure 2:
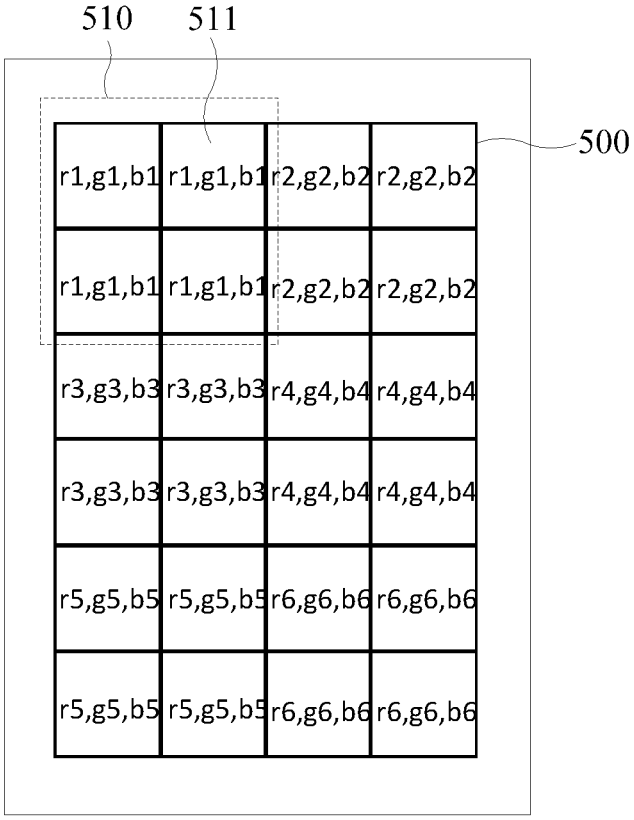
FIG. 2 is a structural diagram of a display area in the related art.

In order to solve the problem of uneven luminance of the display panel, the luminance compensation for the OLED display panel is generally performed in a following manner in the related art: dividing the display area of the OLED display panel into multiple compensation units, where the number and arrangement of pixel units included in each compensation unit are the same; obtaining a compensation coefficient of each compensation unit respectively, and performing luminance compensation on the corresponding compensation unit by using the compensation coefficient. Specifically, FIG. 2 is a structural diagram of a display area in the related art. As shown in FIG. 2, the display area 500 of the display panel is divided into multiple compensation units 510. The number of pixel units 511 included in each compensation unit and the arrangement of these pixel units 511 are the same. In FIG. 2, each pixel unit 511 includes a red sub-pixel r, a green sub-pixel g, and a blue sub-pixel b. The sub-pixels belonging to the same compensation unit 510 have the same subscripts, and the sub-pixels belonging to different compensation units 510 have different subscripts. In actual OLED display panel products, the display quality of different areas in the display area is quite different. When the compensation units in the entire display area are divided in the same manner, a poor compensation effect will be caused in the area with poor display quality, or the amount of compensation coefficient data in area with good display quality will be increased so that it is difficult to implement a better compensation effect with a smaller amount of compensation coefficient data.

Figure 3:
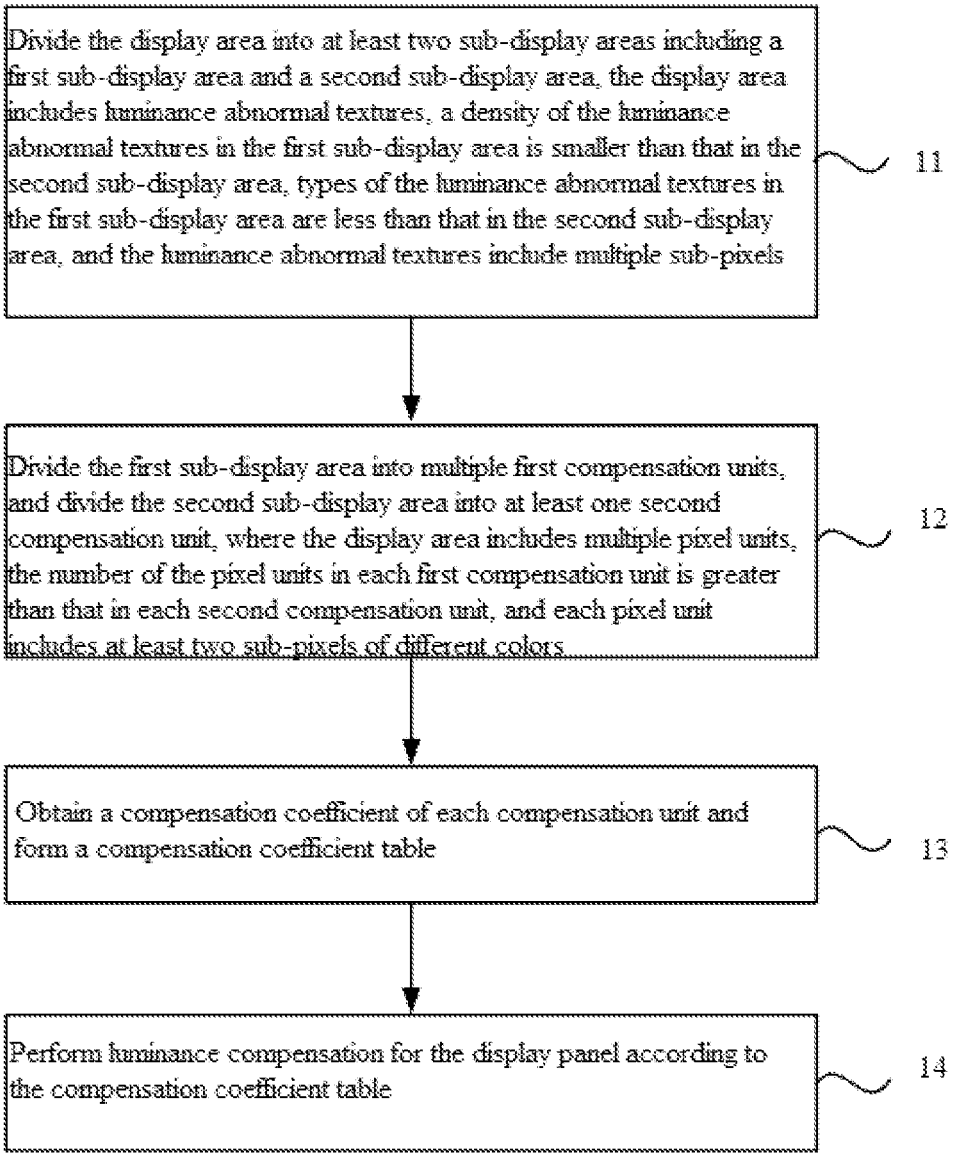
FIG. 3 is a flowchart of a luminance compensation method for a display panel according to an embodiment of the present disclosure.
Figure 4:
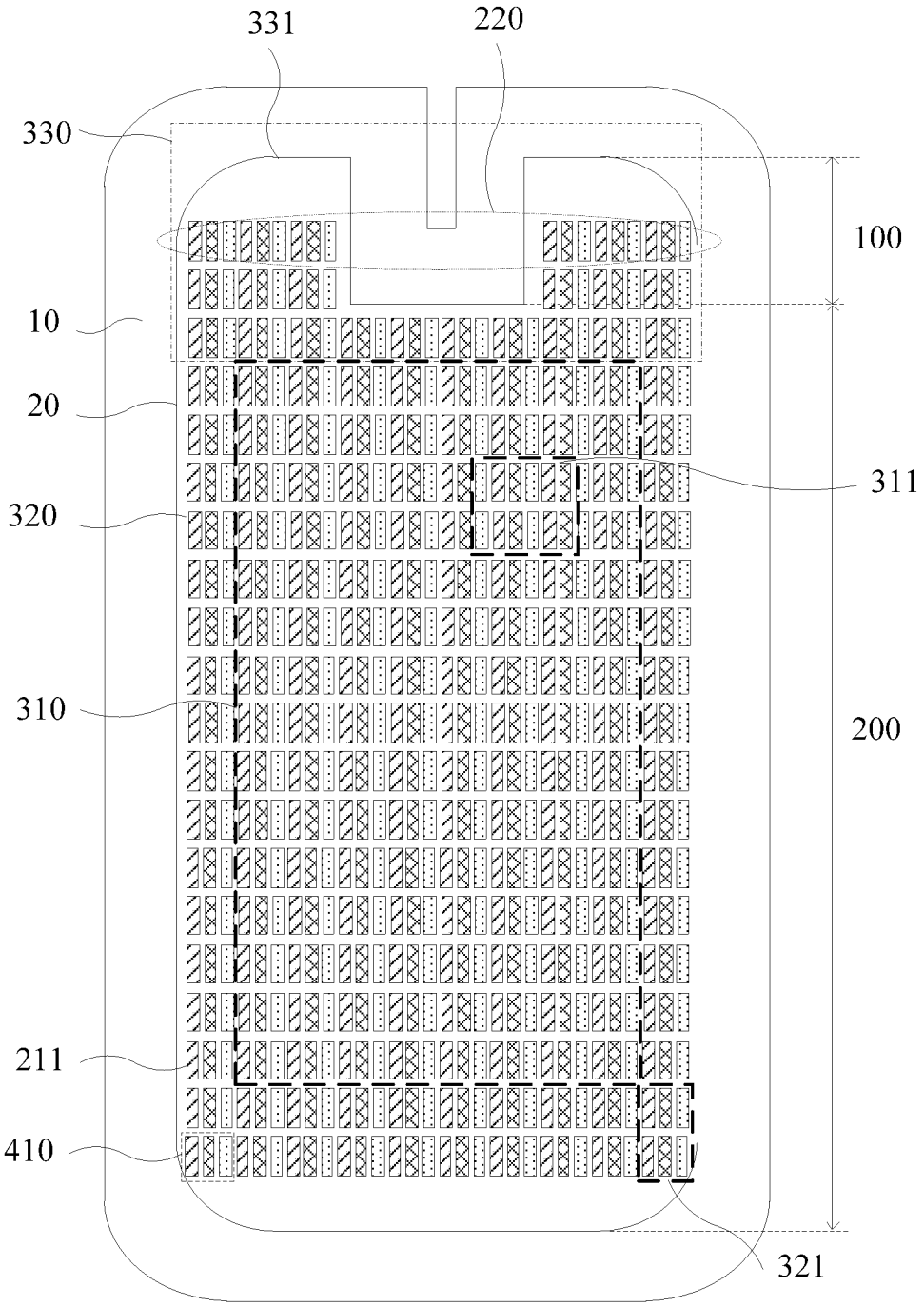
FIG. 4 is a top view of a display panel according to an embodiment of the present disclosure.

FIG. 3 is a flowchart of a luminance compensation method for a display panel according to an embodiment of the present disclosure. The luminance compensation method for the display panel is used for performing luminance compensation on a display panel with poor display quality caused by uneven luminance. FIG. 4 is a top view of a display panel according to an embodiment of the present disclosure. As shown in FIG. 4, the display panel includes a display area 20 and a non-display area 10 surrounding the display area. As shown in FIG. 3, the luminance compensation method for the display panel specifically includes steps described below.

In step 11, the display area is divided into at least two sub-display areas including a first sub-display area and a second sub-display area. Luminance abnormal textures exist in the display area. A density of the luminance abnormal textures in the first sub-display area is less than a density of the luminance abnormal textures in the second sub-display area, and types of the luminance abnormal textures in the first sub-display area are less than types of the luminance abnormal textures in the second sub-display area. The luminance abnormal textures include multiple sub-pixels.

It is to be noted that the luminance abnormal textures are texture visible to the human eye when the display panel normally works, and the luminance of the textures is greatly different from the luminance of the non-texture area. Specifically, the luminance of the abnormal textures is brighter or darker than the non-texture area.

In this embodiment, the density of the luminance abnormal textures refers to the number of luminance abnormal textures per unit area. In addition, the luminance abnormal texture with a certain fixed shape is referred to as a kind of luminance abnormal texture. It may be understood that the luminance abnormal textures with the same shape and size is the same kind of luminance abnormal texture, and otherwise they are different kinds of luminance abnormal texture.

Exemplarily, the display area only includes the first sub-display area and the second sub-display area. The area of both the first sub-display area and the second sub-display area is A. The first sub-display area includes totally 15 luminance abnormal textures in three kinds. The second sub-display area includes totally 20 luminance abnormal textures in five kinds. In this case, the density of the luminance abnormal textures in the first sub-display area is P1=15/A, and the density of the luminance abnormal textures in the second sub-display area is P2=20/A. It may be seen that P2 is greater than P1. That is, the density of the luminance abnormal textures in the first sub-display area is smaller than the density of the luminance abnormal textures in the second sub-display area. In addition, the first sub-display area includes three kinds of luminance abnormal textures, and the second sub-display area includes five kinds of luminance abnormal textures. Therefore, the types of the luminance abnormal textures in the first sub-display area are less than the types of the luminance abnormal textures in the second sub-display area.

It is to be further noted that the display quality of the corresponding sub-display area may be determined according to the density and types of the luminance abnormal textures. The higher the density of the luminance abnormal textures and the more types of the luminance abnormal textures, the poorer the display quality of the sub-display area.

In step 12, the first sub-display area is divided into multiple first compensation units, and the second sub-display area is divided into at least one second compensation unit. The display area includes multiple pixel units. The number of the pixel units in each of the multiple first compensation units is greater than the number of the pixel units in each of the at least one second compensation unit, and each of the multiple pixel units includes at least two sub-pixels of different colors.

Continuously referring to FIG. 4, the display panel includes multiple pixel units 410. Each pixel unit 410 includes three sub-pixels 211 of different colors. The display area 20 of the display panel includes a first sub-display area 310 and a second sub-display area 320. The first sub-display area 310 is divided into multiple first compensation units 311, and the second sub-display area 320 is divided into at least one second compensation unit 321. It is to be noted that, in order to avoid complexity of the drawings, only one first compensation unit 311 and one second compensation unit 321 are shown in FIG. 4, and the structures of other first compensation units 311 and other second compensation units 321 are respectively the same as structures of the shown first compensation unit 311 and the second compensation unit 321. The sub-pixels 211 of different colors are identified with different hatched patterns in FIG. 4.

It is to be noted that the compensation unit is the minimum unit for luminance compensation, and at least one pixel belonging to the same luminance compensation unit adopts the same compensation coefficient for luminance compensation. It may be understood that the more pixel units in the compensation unit, the smaller the total amount of compensation coefficient data used when performing luminance compensation on the display panel, but the coarser the compensation. For the display area with poor display quality, when the number of display units in the compensation unit is large, the luminance difference between adjacent pixel units may not be effectively compensated, and the display effect of the display panel subjected to compensation is not observably improved. For the display area with good display quality, when the number of display units in the compensation unit is small, the compensation coefficients of adjacent multiple compensation units are approximate or even equal, which results in excessive compensation coefficient data and too much processor resources to be occupied. Therefore, the solution in which the entire display is divided into multiple identical compensation units in the same manner may not implement the good compensation effect by using less compensation data. For the above problem, in the embodiment, the display panel is divided into multiple sub-display areas, and the poorer the display quality of the sub-display area, the smaller the number of pixel units in the compensation unit, to effectively improve the display quality of the display panel according to less compensation coefficient data.

In step 13, a compensation coefficient of each compensation unit is obtained and a compensation coefficient table is formed.

Optionally, the compensation coefficient of each compensation unit may be obtained according to a conventional method. For example, as shown in FIG. 4, the average of grayscale of the multiple sub-pixels 211 of the first color in the first sub-display area 310 may be used as a basic grayscale of the sub-pixels 211 of the first color. The difference between the grayscale of the sub-pixel 211 of the first color in the pixel unit 410 in the compensation unit and the above-mentioned basic grayscale is the compensation coefficient of the sub-pixel 211 of the first color in the pixel unit 410. The compensation coefficients of the sub-pixels 211 of different colors in each pixel unit 410 is the compensation coefficient of the pixel unit 410. The compensation coefficient of the compensation unit is obtained according to a preset rule based on the compensation coefficients of at least one pixel unit 410 in the compensation unit. Exemplarily, the average of the compensation coefficients of at least one pixel unit 410 in the compensation unit may be used as the compensation coefficient of the compensation unit.

It is to be noted that the compensation coefficient is obtained according to the grayscale, thus the greyscale of the sub-pixel is compensated when the luminance compensation is performed. Accordingly, the luminance compensation is achieved along with the grayscale compensation due to a correspondence between the grayscale and the luminance.

It is to be noted that a correspondence between the pixel unit and the compensation coefficient of the pixel unit is generally stored in the compensation coefficient table. For a compensation unit including multiple pixel units, the compensation coefficients of the multiple pixel units in the compensation unit are the same and equal to the compensation coefficient of the compensation unit. Therefore, in order to reduce the amount of data storage, a correspondence between one pixel unit in each compensation unit and the compensation coefficient of the compensation unit may be stored in the compensation coefficient table. The pixel unit is a flag pixel unit in the corresponding compensation unit. The position of the flag pixel unit of each compensation unit in each sub-display area is the same, and the position is simultaneously stored.

In step 14, performing luminance compensation on the display panel according to the compensation coefficient table.

It is to be noted that when the luminance compensation is performed, the other pixel units in the compensation unit may be determined according to the position of the flag pixel unit in the compensation unit, and the luminance of the multiple pixel units in the compensation unit is compensated according to the compensation coefficient of the compensation unit corresponding to the flag pixel unit.

According to the luminance compensation method for the display panel provided by the embodiment, the display area of the display panel is divided into at least two sub-display areas, a manner for dividing compensation units in each sub-display area is determined according to the density and types of the luminance abnormal textures in each sub-display area, the compensation coefficient of each divided compensation unit is obtained to form the compensation coefficient table, and the luminance compensation is performed on the display panel according to the compensation coefficient table. Therefore, the higher the density of the luminance abnormal textures and the more types of the luminance abnormal textures the sub-display area has, the fewer pixel units in the compensation unit, thereby implementing the fine compensation for the sub-display area with poor display quality and the large scale uniform compensation for the sub-display area with better display quality, and obtaining a better luminance compensation effect by using less compensation coefficient data.

Exemplarily, a reference luminance difference of the luminance abnormal textures in the first sub-display area is smaller than the reference luminance difference of the luminance abnormal textures in the second sub-display area, where the reference luminance difference of the luminance abnormal textures is an absolute value of a difference between a luminance average of the multiple sub-pixels in the luminance abnormal textures and a preset luminance value.

It is to be noted that, besides the density and the number of luminance abnormal textures, the display quality of the display panel is also related to the reference luminance of the luminance abnormal textures. The higher the density of the luminance abnormal textures, the larger the number of luminance abnormal textures and the larger the reference luminance, the poorer the display quality of the sub-display area. When the sub-display area is divided based on the reference luminance as well as the density and type of the luminance abnormal textures, the difference in display quality of each sub-display area subjected to division is more obvious, and the compensation effect is further improved.

It is to be further noted that the preset luminance value may be a luminance value of pre-designed by the designer, or may be an average of luminance of multiple sub-pixels in a certain area with a good display quality determined according to a preset rule.

Optionally, the at least two sub-display areas further include a third sub-display area. The third sub-display area is divided into at least one third compensation unit. The density of the luminance abnormal textures in the third sub-display area is higher than the density of the luminance abnormal textures in the second sub-display area, and types of the luminance abnormal textures in the third sub-display area are greater than the types of the luminance abnormal textures in the second sub-display area. The number of the pixel units in the third compensation unit is less than the number of the pixel units in the second compensation unit.

It is to be noted that the number of the at least two sub-display areas in the display area is not specifically limited in the embodiment. The foregoing description is made by using the at least two sub-display areas including two or three sub-display areas as an example.

It is to be noted that the higher the density of the luminance abnormal textures and the more types of the luminance abnormal textures, the poorer the display quality of the sub-display area. Therefore, the display quality of the first sub-display area, the second sub-display area and the third sub-display area in the embodiment is sequentially deteriorated. Accordingly, the number of pixel units in compensation units of the first sub-display area, the second sub-display area and the third sub-display area is sequentially decreased to implement finer compensation in the sub-display area with poor display quality, thereby improving the compensation effect.

Continuously referring to FIG. 4, the display area 20 includes a primary area 200 and an extension area 100. The primary area 200 is rectangular or is in a shape similar to the rectangle. The extension area 100 includes two separate protrusions 331, and the two protrusions are connected to the same side of the primary area 200 respectively. The display area includes sub-pixels in p rows and m columns, and the extension area 100 includes n rows of sub-pixels 211. Exemplarily, in FIG. 4, p is 20, m is 30, and n is 2. A sub-pixel row, farthest from the primary area 200, in the extension area 100 is taken as a first row 220. The third sub-display area 330 includes the sub-pixels 211 from the first row to the t1*n-th row and from the first column to the m-th column. The first sub-display area 310 includes the sub-pixels 211 from the (t1*n+1)-th row to the (P−t2*P)-th row and from the (t3*m+1)-th column to the (m−t3*m)-th column. The second sub-display area 320 includes all of the sub-pixels 211 in the display area 20 except the third sub-display area 330 and the first sub-display area 310. $t1 \in [1,2.5]$, $t2 \in [5\%,10\%]$ and $t3 \in [5\%,10\%]$. Specifically, in FIG. 4, the third sub-display area 330 includes the sub-pixels 211 from the 1st row to the 3rd row and from the 1st column to the 30th column, the first sub-display area 310 includes the sub-pixels 211 from the 4th row to the 18th row and from the 4th column to the 17th column, and the second sub-display area 320 includes all of the sub-pixels 211 in the display area 20 except the third sub-display area 330 and the first sub-display area 310. In this case, t1 is 1.5, t2 is 10% and t3 is 10%, p, m and n are integers.

It is to be noted that, in the actual product, the display area of a mobile phone may be the display area 20 shown in FIG. 4, and the display quality of the first sub-display area 310, the second sub-display area 320 and the third sub-display area 330 is sequentially deteriorated. Exemplarily, in this case, the average of luminance value of each sub-pixel in the second sub-display area 320 is used as the preset luminance value, and the reference luminance difference of the luminance abnormal textures may be obtained based on the preset luminance value.

Figure 5:
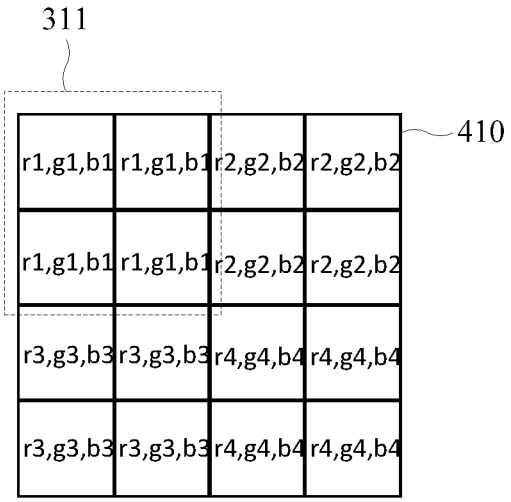
FIG. 5 is a partial enlarged view of a first sub-display area according to an embodiment of the present disclosure.

FIG. 5 is a partial enlarged view of a first sub-display area according to an embodiment of the present disclosure. FIG.

Figure 6:
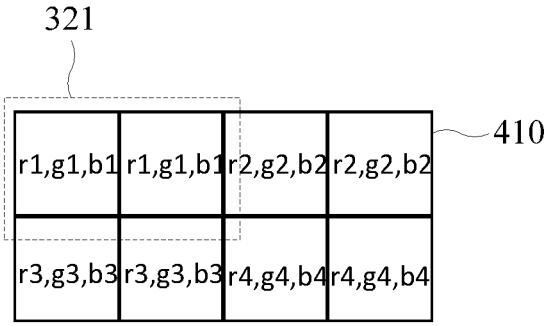
FIG. 6 is a partial enlarged view of a second sub-display area according to an embodiment of the present disclosure.
Figure 7:
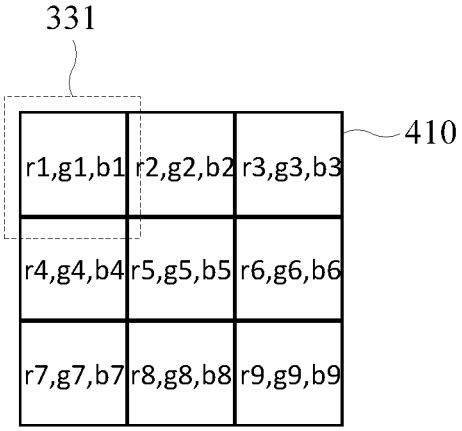
FIG. 7 is a partial enlarged view of a third sub-display area according to an embodiment of the present disclosure.

6 is a partial enlarged view of a second sub-display area according to an embodiment of the present disclosure. FIG. 7 is a partial enlarged view of a third sub-display area according to an embodiment of the present disclosure. It to be noted that the three sub-display areas shown in FIGS. 5, 6 and 7 belong to the display area of the same display panel. Exemplarily, referring to FIGS. 5, 6 and 7, each pixel unit 410 includes a red sub-pixel r, a green sub-pixel g, and a blue sub-pixel b. The sub-pixels belonging to the same compensation unit have the same subscripts, and the sub-pixels belonging to different compensation units have different subscripts. Each grid in FIGS. 5, 6 and 7 represents one pixel unit 410. Specifically, as shown in FIGS. 5, 6 and 7, the number of the pixel units 410 in the first compensation unit may be 4, the number of the pixel units 410 in the second compensation unit 321 may be 2, and the number of the pixel units 410 in the third compensation unit 331 may be 1.

Exemplarily, continuously referring to FIGS. 5, 6 and 7, the multiple pixel units 410 in the display area are arranged in an array, the four pixel units 410 in the first compensation unit 311 are arranged in a shape of a Chinese character "田", and the two pixel units 410 in the second compensation unit 321 are arranged along a row direction of the array.

It is to be noted that FIGS. 5, 6 and 7 are merely illustrative and not restrictive, and in other implementation modes of the embodiment, the number and the structure of pixel units 410 in the first compensation unit 311, the second compensation unit 321 and the third compensation unit 331 may be different with that illustrated in the embodiment, which is not specifically limited in the embodiment.

Exemplarily, the compensation coefficient of the compensation unit may be obtained as follows: when the number of pixel units in the compensation unit is 1, the compensation coefficient of the pixel unit in the compensation unit is used as the compensation coefficient of the compensation unit; when the number of the pixel units in the compensation unit is 2, an average of compensation coefficients of the two pixel units in the compensation unit is used as the compensation coefficient of the compensation unit; and when the number of the pixel units in the compensation unit is at least 3, an average of compensation coefficients of the at least three pixel units in the compensation unit is used as the compensation coefficient of the compensation unit. Alternatively, the maximum compensation coefficient and/or the minimum compensation coefficient among the compensation coefficients of the at least three pixel units is removed and an average of the remained compensation coefficients is used as the compensation coefficient of the compensation unit.

It is to be noted that the compensation coefficient, obtained through solving the average or solving the average after removing the maximum and/or minimum value, is close to the compensation coefficient of more pixel units so that the compensation effect is improved. It may be understood that the compensation coefficient of the compensation units may be obtained through other calculation manners, which is not specifically limited in the embodiment.

Optionally, a correspondence between the compensation coefficient of the compensation unit and a flag pixel unit in the compensation unit is stored in the compensation coefficient table, where the flag pixel unit is a pixel unit in the compensation unit selected according to a preset condition, and positions of the flag pixel units in the different compensation units in the same sub-display area are the same in these compensation units.

Figure 8:
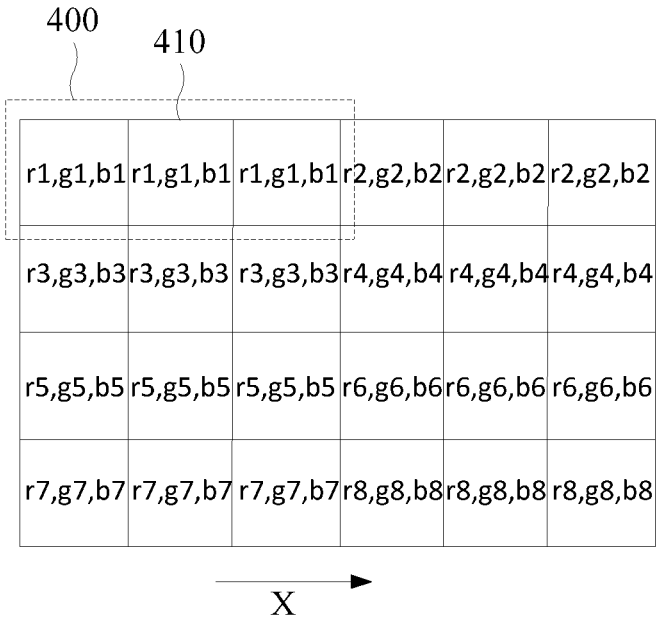
FIG. 8 is a partial structural view of a sub-display area according to an embodiment of the present disclosure.

Exemplarily, FIG. 8 is a partial structural view of a sub-display area according to an embodiment of the present disclosure. It is to be noted that each grid in FIG. 8 represents one pixel unit 410. Exemplarily, each pixel unit 410 in FIG. 8 includes a red sub-pixel r, a green sub-pixel g, and a blue sub-pixel b. The sub-pixels belonging to the same compensation unit 400 have the same subscripts, and the sub-pixels belonging to different compensation units 400 have different subscripts. Specifically, as shown in FIG. 8, the sub-display area includes multiple compensation units 400. Each compensation unit 400 includes three pixel units 410 arranged in an X direction. The flag pixel unit in the sub-display area is the pixel unit 410 located in the middle of each compensation unit 400. The flag pixel unit in each compensation unit 400 and the compensation coefficient of corresponding compensation unit 400 are stored in the compensation coefficient table, and the position of the flag pixel unit in the corresponding compensation unit 400 is recorded at the same time.

It is to be noted that such a design may reduce the data amount stored in the compensation coefficient table, thereby reducing the storage space occupancy and the transmission space occupancy of the compensation coefficient table.

Figure 9:
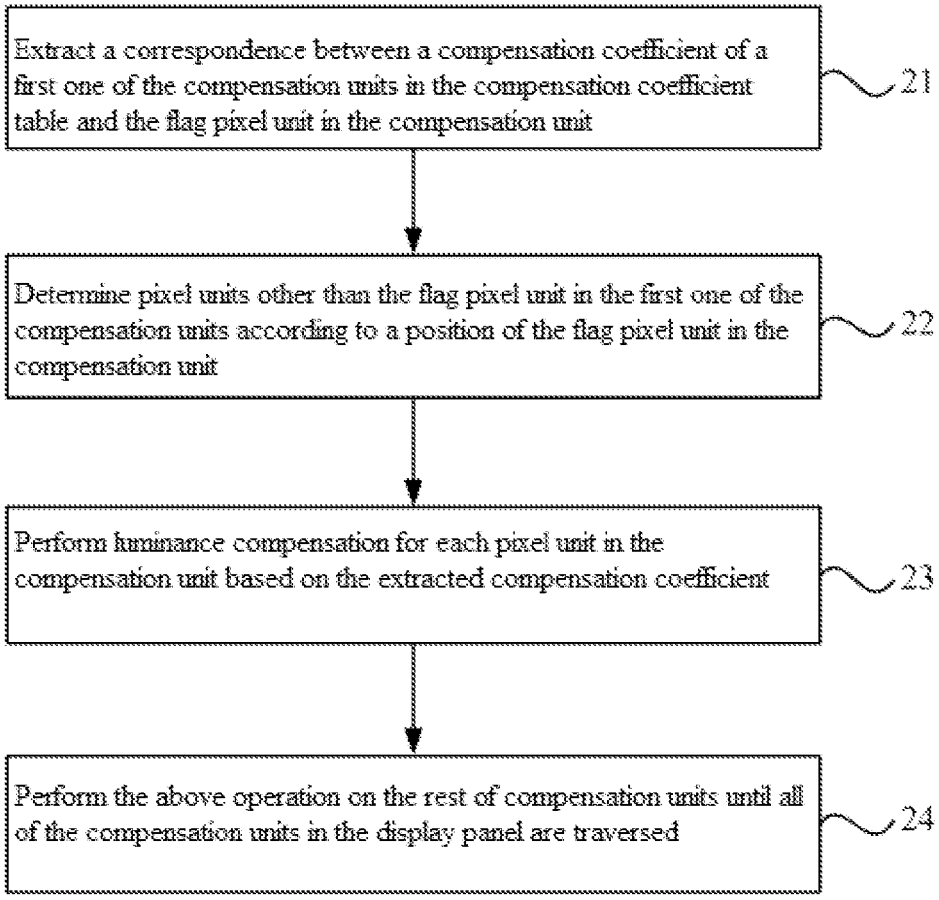
FIG. 9 is a flowchart of luminance compensation for the display panel according to a compensation coefficient table provided by an embodiment of the present disclosure.

Furthermore, FIG. 9 is a flowchart of luminance compensation for the display panel according to a compensation coefficient table according to an embodiment of the present disclosure. As shown in FIG. 9, the luminance compensation for the display panel based on the compensation coefficient table may specifically include steps described below.

In step 21, a correspondence between the compensation coefficient of the first one of the compensation units and the flag pixel unit in the compensation unit in the compensation coefficient table is extracted.

In step 22, pixel units other than the flag pixel unit in the first one of the compensation units are determined according to a position of the flag pixel unit in the first one of the compensation units.

In step 23, the luminance compensation is performed on each pixel unit in the first one of the compensation units based on the extracted compensation coefficient.

In step 24, the above operation is performed on the rest of compensation units until all the compensation units in the display panel are traversed.

It is to be noted that the position of the first compensation unit may be determined according to a preset condition. Exemplarily, for the display area in which the compensation units are arranged in an array, the first compensation unit may be a compensation unit located in the first column and the first row.

Continuously referring to FIGS. 5, 6 and 7, the pixel unit 410 may include three sub-pixels of different colors.

Exemplarily, colors of the three sub-pixels in the same pixel unit 410 are respectively one of red, blue and green.

It is to be noted that red, green and blue are the three primary colors of light, and different intensities of red light, green light and blue light may be mixed to obtain light of various colors. Therefore, the above-mentioned arrangement may make the display panel display various colors and enrich the display color of the display device.

It may be understood that, in the implementation modes of the embodiment, the number and the color of sub-pixels in the pixel unit 410 may further be different, which is not specifically limited in the embodiment.

Figure 10:
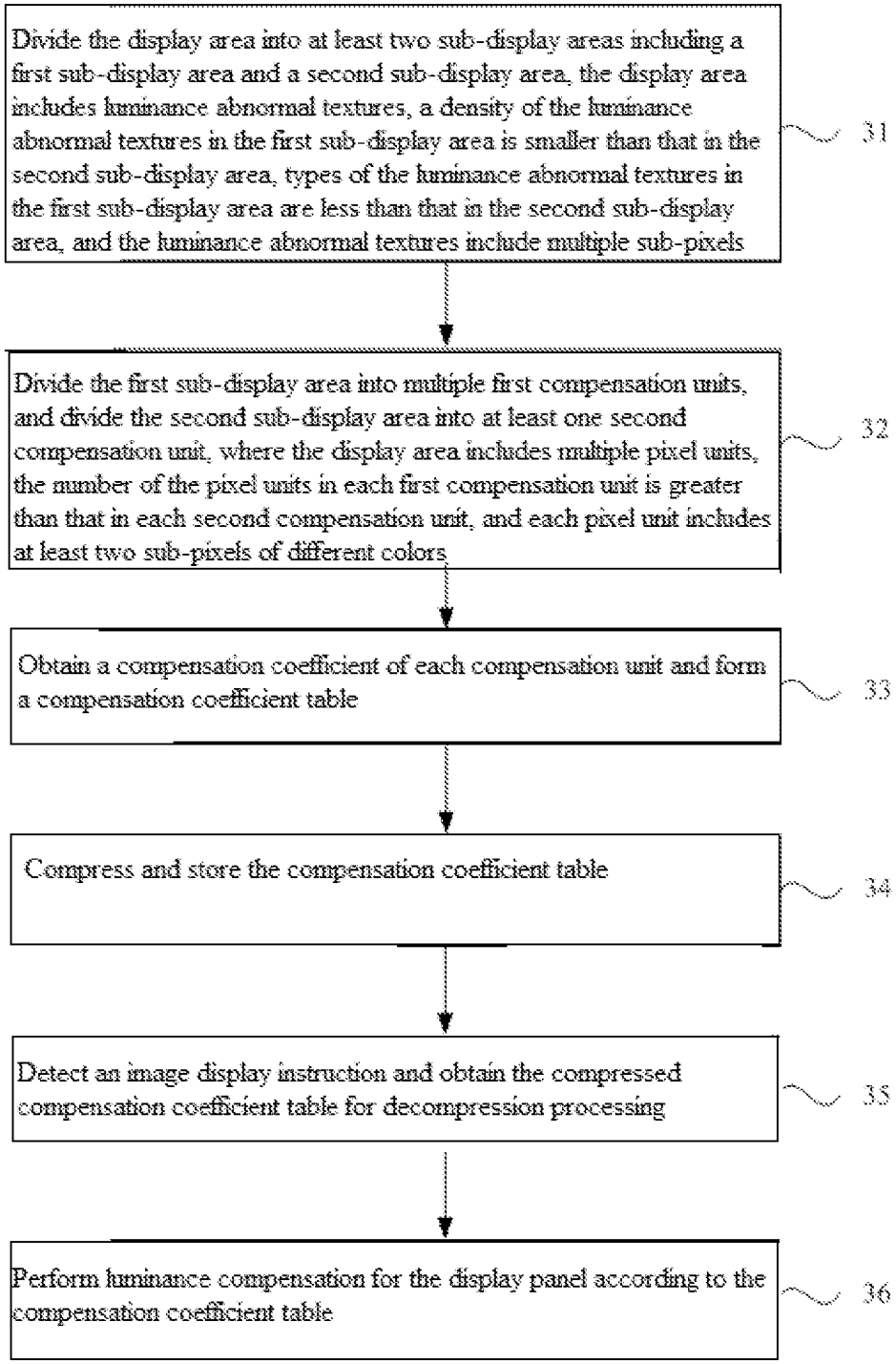
FIG. 10 is a flowchart of another luminance compensation method for a display panel according to an embodiment of the present disclosure.

FIG. 10 is a flowchart of another luminance compensation method for a display panel according to an embodiment of the present disclosure. As shown in FIG. 10, the luminance compensation method of the display panel includes steps described below.

In step 31, the display area is divided into at least two sub-display areas. The at least two sub-display areas include a first sub-display area and a second sub-display area. The display area includes luminance abnormal textures. The density of the luminance abnormal textures in the first sub-display area is smaller than the density of the luminance abnormal textures in the second sub-display area, types of the luminance abnormal textures in the first sub-display area are less than types of the luminance abnormal textures in the second sub-display area. The luminance abnormal textures include multiple sub-pixels.

In step 32, the first sub-display area is divided into multiple first compensation units, and the second sub-display area is divided into at least one second compensation unit. The display area includes multiple pixel units, the number of the pixel units in each first compensation unit is greater than the number of the pixel units in each second compensation unit. Each pixel unit includes at least two sub-pixels of different colors.

In step 33, a compensation coefficient of each compensation unit is obtained and a compensation coefficient table is formed.

In step 34, the compensation coefficient table is compressed and stored.

In step 35, an image display instruction is detected and the compressed compensation coefficient table is obtained for decompression processing.

In step 36, luminance compensation for the display panel is performed according to the compensation coefficient table. It is to be noted that, the storage space of the compensation coefficient table is effectively reduced by storing the compensation coefficient table being compressed, and the resource occupancy is reduced.

It to be noted that the above are only exemplary embodiments of the present disclosure and the technical principles used therein. It will be understood by those skilled in the art that the present disclosure is not limited to the embodiments described herein. Those skilled in the art can make various apparent modifications, adaptations, combinations and substitutions without departing from the scope of the present disclosure. Therefore, while the present disclosure has been described in detail via the above-mentioned embodiments, the present disclosure is not limited to the above-mentioned embodiments and may include more other equivalent embodiments without departing from the concept of the present disclosure. The scope of the present disclosure is determined by the scope of the appended claims.

What is claimed is:

1. A luminance compensation method for a display panel, wherein the display panel comprises a display area and a non-display area surrounding the display area, and the luminance compensation method comprises:

dividing the display area into at least two sub-display areas, wherein the at least two sub-display areas comprise a first sub-display area and a second sub-display area, wherein the display area comprises luminance abnormal textures, a density of the luminance abnormal textures in the first sub-display area is smaller than a density of the luminance abnormal textures in the second sub-display area, and a number of types of the luminance abnormal textures in the first sub-display area is less than a number of types of the luminance abnormal textures in the second sub-display area, wherein each of the luminance abnormal textures comprise a plurality of sub-pixels;

dividing the first sub-display area into a plurality of first compensation units, and dividing the second sub-display area into at least one second compensation unit, wherein the display area comprises a plurality of pixel units, a total number of the pixel units in each of the plurality of first compensation units is greater than a total number of the pixel units in each of the at least one second compensation unit, and each of the plurality of pixel units comprises at least two sub-pixels of different colors;

obtaining a compensation coefficient of each of the plurality of first compensation units and the at least one second compensation unit, and forming a compensation coefficient table; and performing luminance compensation for the display panel according to the compensation coefficient table;

wherein the luminance abnormal textures are textures visible to the human eye when the display, panel normally works, and the luminance of the abnormal textures is brighter or darker than a non-texture area;

wherein the density of the luminance abnormal textures refers to a number of luminance abnormal textures per unit area;

wherein luminance abnormal textures with a same shape and size belong to a same type of luminance abnormal textures;

wherein the method is performed by at least one processor.

2. The luminance compensation method of claim 1, wherein a reference luminance difference of the luminance abnormal textures in the first sub-display area is smaller than the reference luminance difference of the luminance abnormal textures in the second sub-display area, wherein the reference luminance difference of the luminance abnormal textures is an absolute value of a difference between a luminance average of the plurality of sub-pixels in the luminance abnormal textures and a preset luminance value.

3. The luminance compensation method of claim 1, wherein the at least two sub-display areas further comprise a third sub-display area, and the third sub-display area is divided into at least one third compensation unit, wherein the density of the luminance abnormal textures in the third sub-display area is higher than the density of the luminance abnormal textures in the second sub-display area, and types of the luminance abnormal textures in the third sub-display area are greater than the types of the luminance abnormal textures in the second sub-display area; and a total number of pixel units in each of the at least one third compensation unit is less than the total number of the pixel units in each of the at least one second compensation unit.

4. The luminance compensation method of claim 3, wherein the display area comprises a primary area and an extension area, wherein the primary area is rectangular in shape, and the extension area comprises two separate protrusions, and the two protrusions are connected to a same side of the primary area respectively;

the display area comprises sub-pixels in p rows and m columns, and the extension area comprises n rows of sub-pixels; and wherein a sub-pixel row; farthest from the primary area, in the extension area is taken as a first row, wherein the third sub-display area comprises the sub-pixels from the first row to a t1*n-th row and from a first column to an m-th column, the first sub-display area comprises the sub-pixels from a t1*n+1-th row to a P−t2*P-th row and from a t3*m+1 column to an m−t3*m-th column, and the second sub-display area comprises all of the sub-pixels in the display area other than the third sub-display area and, the first sub-display area, wherein t1∈[1,2.5], t2∈[5%,10%] and t3∈[5%,10%], p, m and n are integers.

5. The luminance compensation method of claim 3, wherein the number of the pixel units, in each attic plurality of first compensation units is 4, the number of the pixel units in each of the at least one second compensation unit is 2, and the number of the pixel units in each of the at least one third compensation unit is 1.

6. The luminance compensation method of claim 5, wherein the plurality of pixel units in the display area are arranged in an array;

the four pixel units in each of the plurality of first compensation units are arranged in a shape of a Chinese character "田"; and the two pixel units in each of the at least one second compensation unit are arranged in a row direction of the array.

7. The luminance compensation method of claim 1, wherein the obtaining a compensation coefficient of each of the plurality of first compensation units and the at least one second compensation unit comprises:

in response of determining that the number of pixel units in the each of first compensation units or the at least one second compensation unit is 1, taking a compensation coefficient of the pixel unit, in each of the first compensation units or the at least one second compensation unit as the compensation coefficient of said first compensation unit or said second compensation unit;

in response of determining that the number of the pixel units in each of the first compensation units or the at least one second compensation unit is 2, taking an average of compensation coefficients of the two pixel units in each of the first compensation units or the at least one second compensation unit as the compensation coefficient of said first compensation unit or said second compensation unit; and in response of determining that the number of the pixel units in each of the first compensation units or the at least one second compensation unit is at least 3, taking an average of compensation coefficients of the at least three pixel units in each of the first compensation units or the at least one second compensation unit as the compensation coefficient of said first compensation unit or said second compensation unit, or removing the pixel unit with a maximum compensation coefficient in each of the first compensation unit or the at least one second compensation unit and taking an average of compensation coefficients of the remained pixel units as the compensation coefficient of said first compensation unit or said second compensation unit.

8. The luminance compensation method of claim 1, wherein the obtaining a compensation coefficient of each of the plurality of first compensation units and the at least one second compensation unit comprises:

in response of determining that the number of pixel units in the each of first compensation units or the at least one second compensation unit is 1, taking a compensation coefficient of the pixel unit in each of the first compensation units or the at least one second compensation unit as the compensation coefficient of said first compensation unit or said second compensation unit;

in response of determining that the number of the pixel units in each of the first compensation units or the at least one second compensation unit is 2, taking an average of compensation coefficients of the two pixel units in each of the first compensation units or the at least one second compensation unit as the compensation coefficient of said first compensation unit or said second compensation unit; and in response of determining that the number of the pixel units in each of the first compensation units or the at least one second compensation unit is at least 3, taking an average of compensation coefficients of the at least three pixel units in each of the first compensation units or the at least one second compensation unit as the compensation coefficient of said first compensation unit or said second compensation unit, or removing the pixel unit with a minimum compensation coefficient in each of the first compensation unit or the at least one second compensation unit and taking an average of compensation coefficients of the remained pixel units as the compensation coefficient of said first compensation unit or said second compensation unit.

9. The luminance compensation method of claim 1, wherein the obtaining a compensation coefficient of each of the plurality of first compensation units and the at least one second compensation unit comprises:

in response of determining that the number of pixel units in the each of first compensation units or the at least one second compensation unit is 1, taking a compensation coefficient of the pixel, unit in each of the first compensation units or the at least one second compensation unit as the compensation coefficient of said first compensation unit or said second compensation unit;

in response of determining that the number of the pixel units in each of the first compensation units or the at least one second compensation unit is 2, taking an average of compensation coefficients of the two pixel units in each of the first compensation units or the at least one second compensation unit as the compensation coefficient of said first compensation unit or said second compensation unit; and in response of determining that the number of the pixel units in each of the first compensation units or the at least one second compensation unit is at least 3, taking an average of compensation coefficients of the at least three pixel units in each of the first compensation units or the at least one second compensation unit as the compensation coefficient of said first compensation unit or said second compensation unit, or removing the pixel unit with a maximum compensation coefficient and a minimum compensation coefficient in each of the first compensation unit or the at least one second compensation unit and taking an average of compensation coefficients of the remained pixel units as the compensation coefficient of said first compensation unit or said second compensation unit.

10. The luminance compensation method of claim 1, wherein a correspondence between the compensation coefficient of each of the plurality of first compensation units or the at least one second compensation unit and a flag pixel unit in said first compensation unit or said second compensation unit is stored in the compensation coefficient table, wherein the flag pixel unit is a pixel unit selected from each of the plurality of first compensation units or the at least one second compensation unit according to a preset condition, and the flag pixel units in different compensation units in a same sub-display area are located in the same position in these compensation units.

11. The luminance compensation method of claim 10, wherein the performing luminance compensation for the display panel according to the compensation coefficient table comprises:

extracting a correspondence between the compensation coefficient of a first one of the compensation units in the compensation coefficient table and the flag pixel unit in the compensation unit;

determining pixel units other than the flag pixel unit in the first one of the compensation units according to a position of the flag pixel unit in the first one of the compensation units;

performing luminance compensation for each pixel unit in the first one of the compensation units based on the extracted compensation coefficient; and performing the above steps on the rest of compensation units until all of the plurality of first compensation units and the at least one second compensation unit in the display panel are traversed.

12. The luminance compensation method of claim 1, wherein each of the plurality of pixel units comprises three sub-pixels of different colors.

13. The luminance compensation method of claim 12, wherein colors of the three sub-pixels in the same pixel unit are red, blue and green respectively.

14. The luminance compensation method of claim 1, further comprising:

after the forming a compensation coefficient table, compressing the compensation coefficient table and storing the compensation coefficient table being compressed; and before the performing luminance compensation for the display panel according to the compensation coefficient table, detecting an image display instruction, and obtaining and decompressing the compensation coefficient table being compressed.

* * * * *